US007279854B2

(12) United States Patent
Nerone

(10) Patent No.: US 7,279,854 B2
(45) Date of Patent: Oct. 9, 2007

(54) CHARGE PUMP INTERFACE CIRCUIT

(75) Inventor: Louis Robert Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/289,153

(22) Filed: Nov. 29, 2005

(65) Prior Publication Data

US 2006/0113923 A1 Jun. 1, 2006

Related U.S. Application Data

(60) Provisional application No. 60/631,895, filed on Nov. 30, 2004.

(51) Int. Cl.
*H05B 37/02* (2006.01)

(52) U.S. Cl. ..... 315/307; 315/361; 307/80

(58) Field of Classification Search ..... 315/209 R, 315/224, 225, 226, 247, 291, 307, 312, 315, 315/320, 323, 361, 362; 307/64, 80
See application file for complete search history.

(56) References Cited

U.S. PATENT DOCUMENTS 4,477,748 A * 10/1984 Grubbs ..... 315/306
5,751,115 A * 5/1998 Jayaraman et al. ..... 315/225
5,834,903 A * 11/1998 Christian ..... 315/219
6,031,338 A * 2/2000 Yoon et al. ..... 615/209 R
6,628,091 B2 * 9/2003 Griffin et al. ..... 315/291
6,686,705 B2 2/2004 Nerone et al. ..... 315/291
6,771,029 B2 * 8/2004 Ribarich et al. ..... 315/292

OTHER PUBLICATIONS

Haiyan Wang, "A Discrete Dimming Ballast for Linear Fluorescent Lamps", paper submitted in partial fulfillment of requirement for degree, Master of Science at Cleveland State University, Dec. 2003, 57 pages, Cleveland, Ohio, USA.

* cited by examiner

*Primary Examiner*—Douglas W. Owens
*Assistant Examiner*—Jimmy Vu
(74) *Attorney, Agent, or Firm*—Fay Sharpe LLP

(57) ABSTRACT

A ballast circuit including a charge pump interface circuit is disclosed to provide a method of isolating a switch from a power line used to power a ballast for supplying electrical power to a lamp. In addition, the charge pump interface circuit provides a method to control a discrete dimming ballast circuit which includes one or more inverters. The charge pump interface circuit offers cost advantages because no relays are necessary for isolation of the switch from the lamp electrical power and the dimming ballast circuit can be installed where existing lamps are currently mounted, without the need to add additional wiring.

17 Claims, 3 Drawing Sheets

CHARGE PUMP INTERFACE CIRCUIT

BACKGROUND

This application claims priority to and the benefit of U.S. Provisional Application No. 60/631,895, filed Nov. 30, 2004, which application is incorporated herein by reference in its entirety.

The present disclosure relates to a method of isolating a control signal from a power line using a charge pump circuit. It finds particular application in conjunction with ballast controlled gas discharge lamps and discrete dimming systems and will be described with particular reference thereto. However, it is to be appreciated that the exemplary embodiments of this disclosure are also amenable to other like applications.

Many types of dimming ballasts have been proposed that control the arc current of a gas discharge lamp such as a fluorescent lamp. One type includes an external means of heating the cathode to prevent sputtering of the cathodes whenever the arc current is reduced to less than 50% of its rated value. The efficiency of such a dimming circuit falls off as the light intensity is reduced.

Multiple ballast dimming systems control fluorescent lamps either in pairs or individually. For example, a three lamp fixture may have a two lamp ballast and one lamp ballast whereby the light intensity can be changed from 33% to 100% of its rated value by turning on a specific ballast. This requires at least two ballasts to cover a 3 to 1 range in brightness, which may increase cost and impact the available space in the fixture. Also, a latching relay is used to turn the ballasts on and off which requires a power supply to activate the relay coil.

Dimming systems capable of operation, as described above, are further described in U.S. Pat. No. 6,686,705, issued to Nerone et al., and "A Discrete Dimming Ballast for Linear Fluorescent Lamps", authored by Haiyan Wang, and these references are hereby totally incorporated by reference.

A better system capable of powering a plurality of lamps is desirable from an efficiency perspective and from a packaging and cost perspective. In addition, it is desirable to have a circuit to isolate a low voltage control signal used for activating discrete dimming levels without using external power supplies from the power line voltage, the low voltage control signal selecting individual lamps for a discrete dimming system.

BRIEF DESCRIPTION

According to one embodiment of this disclosure, a switch circuit is provided, the switch circuit comprising a high frequency oscillator; a first latch; a first, second and third capacitor; and a first diode and a second diode. The first capacitor's first electrode is operatively connected to the output of the high frequency oscillator, the second capacitor's first electrode is operatively connected to the anode of the first diode and the cathode of the second diode, the third capacitor's first electrode is operatively connected to the cathode of the first diode and the input to the latch, and the cathode of the second diode is operatively connected to the third capacitor's second electrode and the high frequency oscillator common ground.

According to another embodiment of this disclosure, a ballast lamp circuit is provided, the ballast lamp circuit, comprising one or more inverters configured to receive power from a single DC power source, each inverter for selectively powering a load and a controller operatively coupled to each of the one or more inverters via an on/off control signal for selectively switching on and off each inverter independently. The controller comprises one or more switch circuits, each switch circuit comprising a high frequency oscillator; a first latch including a first, second and third capacitor, and a first diode and a second diode. The first capacitor's first electrode is operatively connected to the output of the high frequency oscillator, the second capacitor's first electrode is operatively connected to the anode of the first diode and the cathode of the second diode, the third capacitor's first electrode is operatively connected to the cathode of the first diode and the input to the latch, and the cathode of the second diode is operatively connected to the third capacitor's second electrode and the high frequency oscillator common ground.

According to another embodiment of this disclosure, a ballast lamp circuit is provided, the ballast lamp circuit comprising a means for inverting a DC voltage to one or more AC waveforms for selectively driving one or more lamps; a means for isolating one or more switches, the one or more switches selectively controlling the one or more AC waveforms for selectively driving one or more lamps.

According to another embodiment of this disclosure, a method of isolating a switch is provided, the method comprising generating a high frequency low voltage AC waveform; operatively connecting the high frequency low voltage AC waveform to a first pole of the switch via a first capacitor; and operatively connecting a second pole of the switch to a second capacitor, the second capacitor serially connected to a first diode and third capacitor, wherein the voltage across the third capacitor increases for each cycle of the high frequency low voltage AC waveform while the switch is closed, until a maximum voltage is obtained, and the first and second capacitor values are selected to provide substantial isolation of the switch from the voltage across the third capacitor and the high frequency low voltage AC waveform.

DETAILED DESCRIPTION

Figure 1:
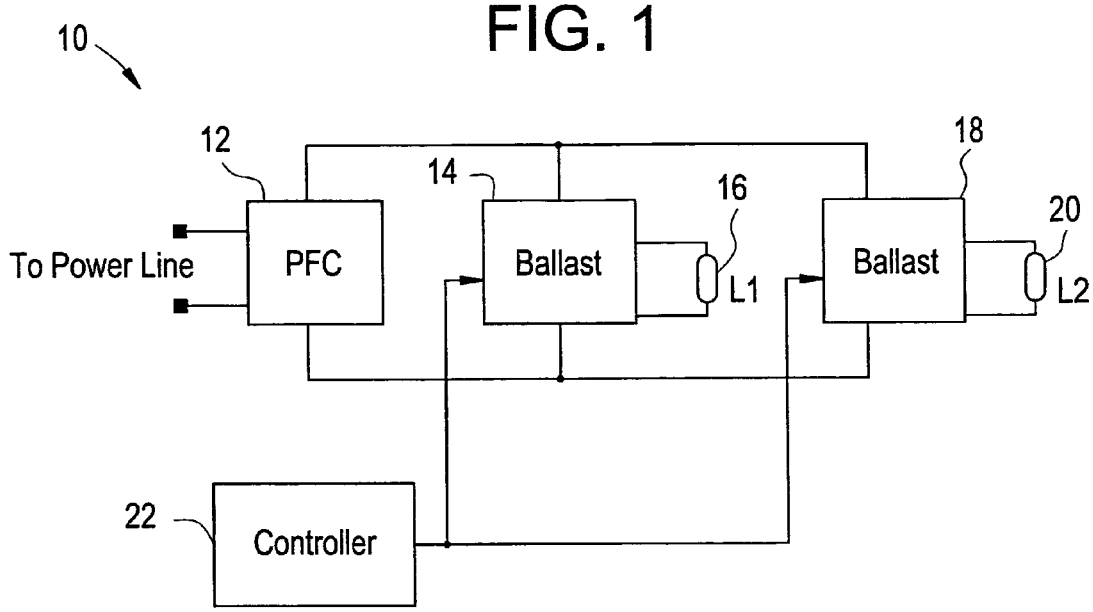
FIG. 1 is a block diagram of one exemplary embodiment including a plurality of inverters.

With reference to FIG. 1, illustrated is a schematic representation of a gas discharge lamp dimming system 10 according to one exemplary embodiment of this disclosure. This dimming system includes a power factor correction (PFC) circuit 12, two ballast circuits 14 and 18 and two fluorescent lamps L1 16 and L2 20 operatively connected to each ballast 14 and 18, respectively. A controller 22 selectively controls ballasts 14 and 18 to power the lamps L1 16 and L2 18, respectively.

Dimming is achieved, for the lamp system 10 illustrated in FIG. 1, by selectively illuminating only lamp L1 16 and only lamp L2 20. Full lumen output is achieved by selectively illuminating lamp L1 16 and lamp L2 20. While a two ballast/lamp circuit combination will be described with further detail, this disclosure is not limited to a two lamp operation. For example, three, four, five, six, etc. ballast/lamp combinations are within the scope of this disclosure. As the number of lamps increases, the greater the number of possible dimming modes. In addition, other variations of the dimming system include powering more than one lamp from a single ballast. Multiple lamp operation from a single ballast provides a technique to control multiple dimming modes and full power luminescence of a lamp system.

With further reference to FIG. 1, a more detailed description of the lamp system is provided.

The lamp system 10 is powered by an AC power source (not shown), such as 120 VAC, 277 VAC, etc. depending on the power line voltage availability. A PFC circuit rectifies the AC power and generates a DC voltage which is fed to ballasts 14 and 18 as illustrated. Each ballast inverts the DC voltage to produce an AC waveform to power lamps L1 16 and L2 20.

The controller 22 selectively controls ballast 14 and/or 18 to drive lamps L1 16 and L2 20. As previously discussed, dimming can be achieved by illumination of only one lamp.

To provide an input signal to the controller 22 for selecting which lamps to turn on and which lamps to turn off, a switch arrangement is incorporated within the controller 22, according to one embodiment of this disclosure. Techniques for providing a control signal to the controller 22 include a push button switch, toggle switch, relay, logic driven switch, etc., and are within the scope of this disclosure.

Figure 2:
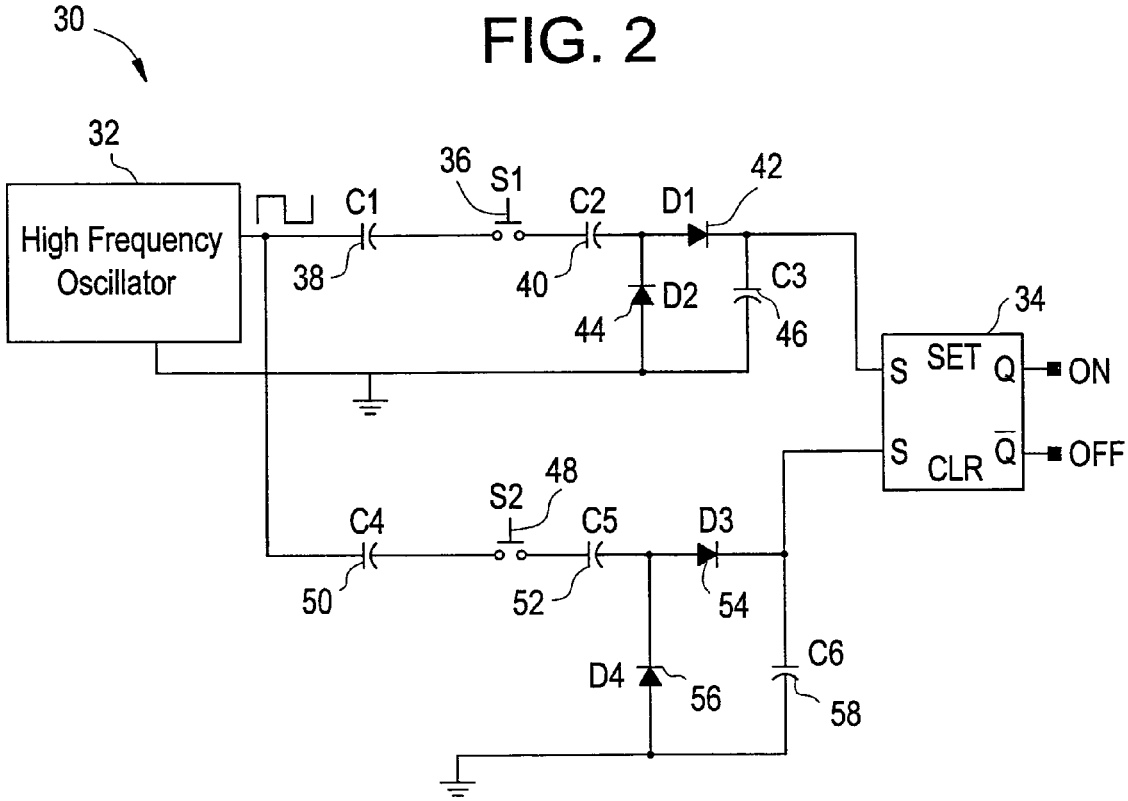
FIG. 2 is a circuit diagram of a switch isolation circuit according to another exemplary embodiment.

With reference to FIG. 2, a switch circuit 30 according to one exemplary embodiment of this disclosure is illustrated. The switch circuit 30 includes a charge pump circuit to provide acceptable levels of isolation between a user operated switch, and the PFC, ballast, and lamp circuit previously described with reference to FIG. 1. The switch circuit 30 is described as being housed within the controller 22 for illustration purposes. However, as will be appreciated by those of skill in the art, the switch circuit 30 can also be housed in an independent enclosure which is operatively connected to the controller 22. The switch circuit 30 comprises a high frequency oscillator U1 32, a logic driven latch 34, switch S1 36, capacitor C1 38, capacitor C2 40, diode D1 42, diode D2 44 and capacitor C3 46. In general, switch S1 36 activates an output Q of the latch which is operatively connected to a ballast via the controller. The latch output Q signals the controller of FIG. 1 to turn on a respective lamp via the respective ballast.

With further reference to FIG. 2, a second switch circuit is illustrated that is operatively connected to the high frequency oscillator U1 32 and the logic driven latch 34. The second switch circuit comprises switch S2 48, capacitor C4 50, capacitor C5 52, diode D3 54, diode D4 56 and capacitor C6 58. This second switch circuit provides a signal to the latch which sets a control signal $\overline{Q}$. This latch output is operatively connected to a ballast via the controller 22 and turns the lamp and ballast combination off.

A more detailed description of the switch circuits and their operation will now be described. In one embodiment, the high frequency oscillator U1 32 generates a high frequency voltage approximately equal to 100 kHz. Initially, with switch S1 36 in a normally open position, no voltage is present across capacitor C3 46 and therefore the logic latch output "on" is not set to turn on a ballast lamp combination. Moreover, initially, with switch S2 48 in a normally open position, no voltage is present across capacitor C6 58 and the latch output "off" is not set to turn a ballast and lamp combination off.

To provide acceptable levels of switch isolation from the common ground, capacitor C1 38 and capacitor C2 40 are selected sufficiently small to provide a relatively large impedance at the power line frequency, ex. 60 Hz. For example, in one exemplary embodiment of this disclosure, the series combination of capacitor C1 38 and C2 40 yields a capacitance of only 11 pF if C1=C2=22 pF. The impedance of this equivalent capacitance is 240 Meg ohms at 60 Hz. Therefore, the amount of current that is capable of passing to earth ground is only 1 uA, well below the UL limits for current flow through a human host.

To provide an acceptable switch response time for control of the lamps and provide sufficient noise immunity one exemplary embodiment of this disclosure comprises capacitor C3 46 equal to approximately 100 nF when the serial equivalence of capacitor C1 38 and C2 40=5 pF-100 pF. More specifically, when capacitor C1 38 and capacitor C2 40 equals approximately 22 pF. In general, the ratio of capacitor C3 to the equivalent capacitance of C1+C2 is approximately four orders of magnitude. Subsequent to switch S1 36 being depressed, the high frequency oscillator 32 charges capacitors C1 38, C2 40 and C3 46 during the next positive ½ cycle. It should be noted that multiple cycles of the oscillator are required to charge capacitor C3 to a sufficient level to provide a logic input voltage sufficient to set the latch output. During the subsequent negative oscillator ½ cycle, diode D1 42 prevents capacitor C3 46 from discharging until it can continue to charge during the next oscillator positive ½ cycle. Diode D2 44 provides a return path for the negative oscillator ½ cycle generated current.

Figure 3:
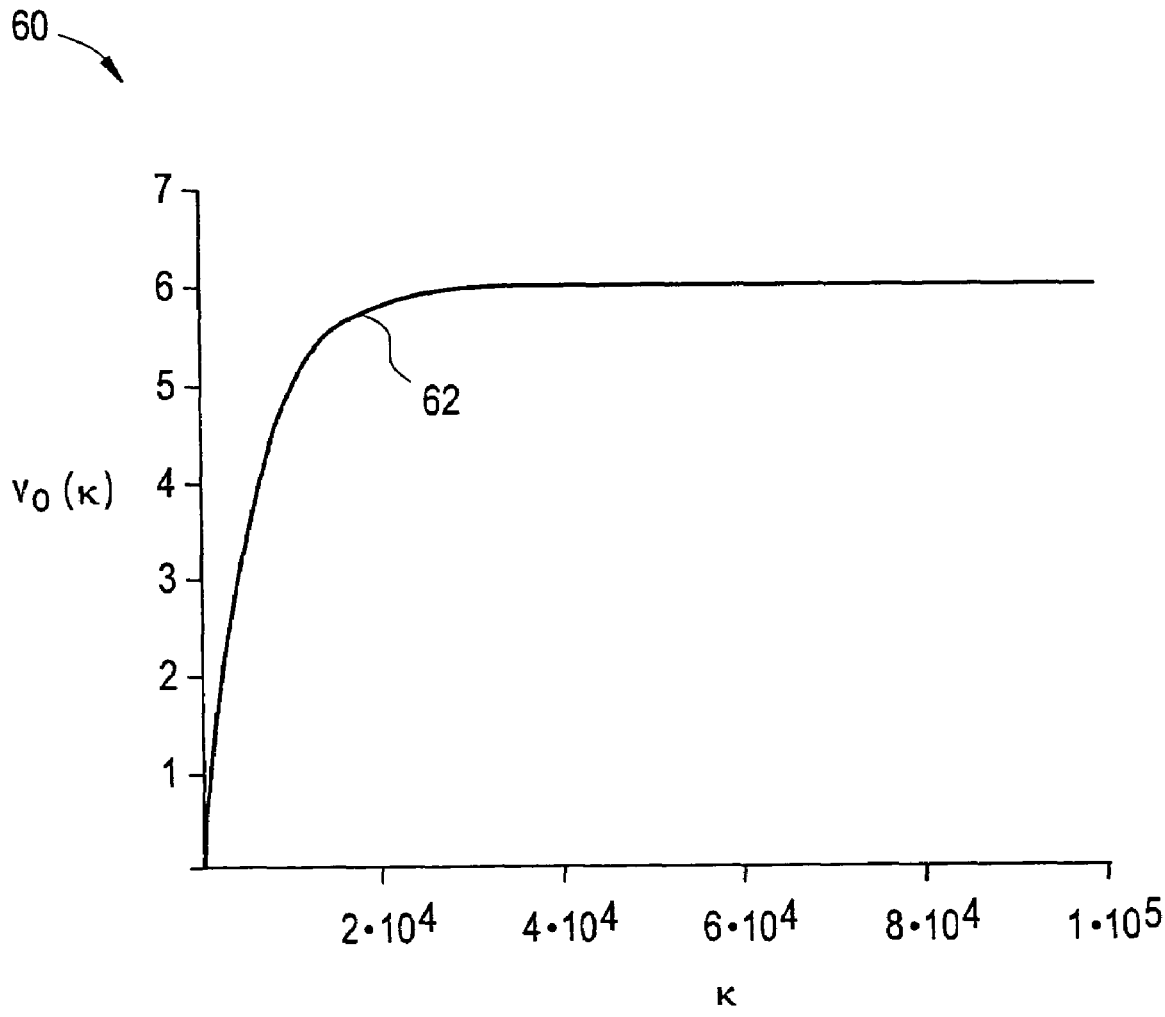
FIG. 3 is a graph of C3 voltage as a function of inverter cycles.

With reference to FIG. 3, illustrated is a graph 60 representing the voltage 62 across capacitor C3 46 as a function of inverter cycles. Each inverter cycle, K, corresponds to 5 ms. In other words, the switch operator will be required to depress switch S1 for a relatively short time to charge capacitor C3 sufficiently to set the latch output "on". After the logic latch output "on" is set, it will remain set until the second switch circuit including switch S2, sets the latch "off" output.

The second switch circuit comprising U1 32, C4 50, C5 52, C6 58, D3 54, D4 56, S2 48 and the logic latch 34 operates as described previously with reference to the first switch circuit. Together, the combination of two switch circuits, as described heretofore provides a switch circuit and method of operating a switch circuit to isolate a user operated switch, such as a push button switch or other manual/automatic switch, from common ground at acceptable UL standards. In addition, by selecting the appropriate values of capacitors C1 38, C2 40, C4 50 and C6 58, other isolation standards can be implemented.

Other variations of the switch circuit described heretofore comprise selecting a relatively larger value of capacitor C3 46 to increase the delay associated with setting a latch output 34. Conversely, a smaller capacitance for capacitor C3 46 can be selected to decrease the delay if noise considerations are acceptable for reliable operation.

Substantially, the method of isolating a switch as disclosed comprises generating a high frequency low voltage AC waveform and operatively connecting the high frequency low voltage AC waveform to a first pole or input of a switching type device, via a sufficiently small capacitance at the power line operating frequency, to isolate the first pole switch at acceptable standards. In addition, a second pole of the switching type device is operatively connected to a second capacitor, similar in size to the first capacitor, the second capacitor serially connected to a third capacitor, via a diode, which is substantially larger than the equivalence of the first capacitor and the second capacitor. This switching method provides a voltage across the third capacitor which increases for each cycle of the high frequency low voltage AC waveform while the switch is closed until a maximum voltage is obtained. The voltage across the third capacitor is used to drive a logic device.

In one embodiment of the switching circuit and method as described heretofore, the following components are as follows:

C1=22 pF;
C2=22 pF;
C3=100 nF;
U1=approximately 100 kHz;
D1, D2, D3 and D4 are iN4148 diodes; and
the Latch is a S-R Flip Fop latch.

Figure 4:
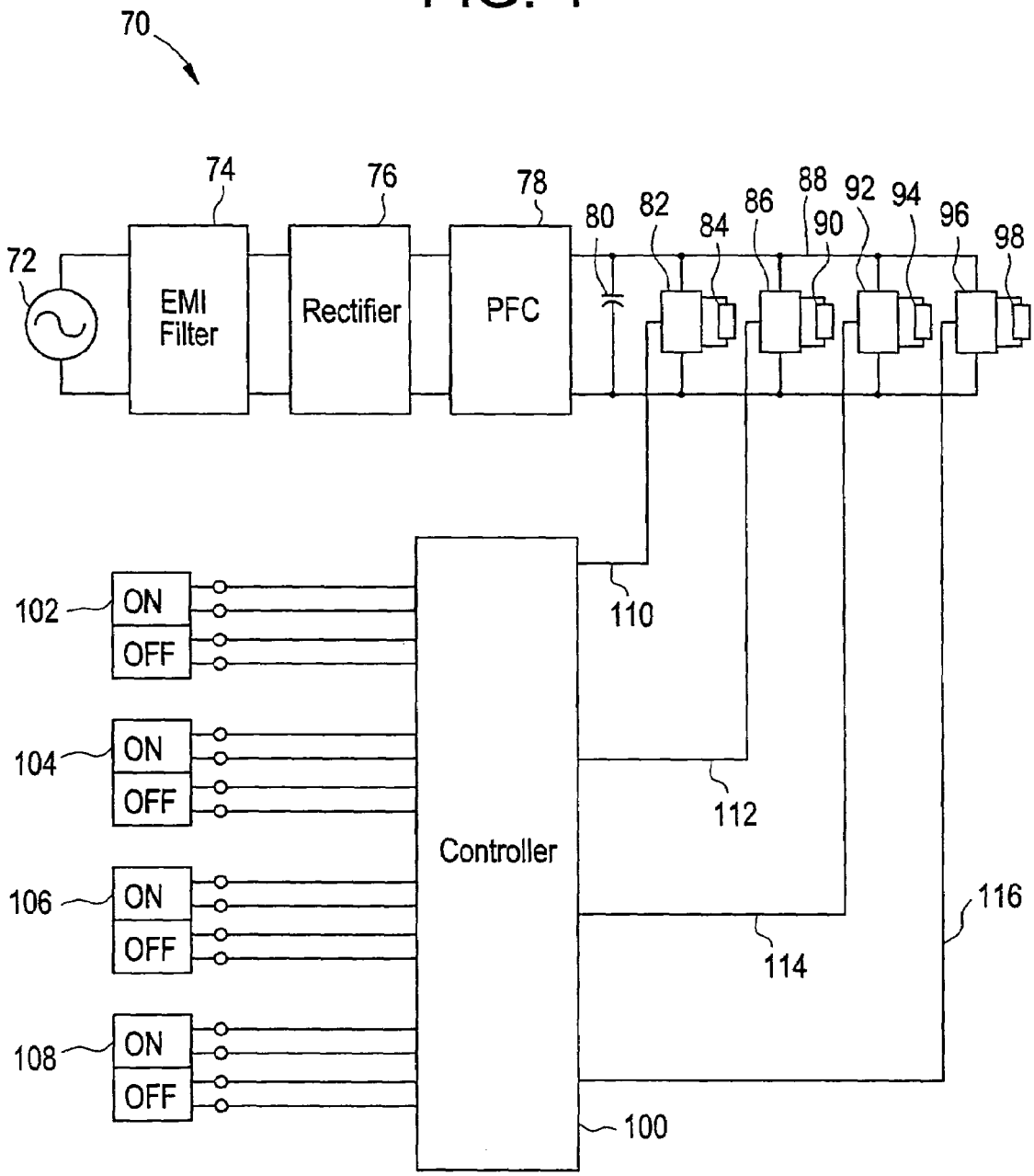
FIG. 4 is a block diagram of another exemplary embodiment including a plurality of inverters and a plurality of low voltage push button switches.

FIG. 4 illustrates another ballast lamp circuit 70 in accordance with one exemplary embodiment. The ballast circuit includes an AC power source 72, an electromagnetic interference EMI filter 74, a bridge rectifier 76, a power factor correction circuit 78, a bus capacitor 80, four inverters 82, 86, 90 and 93, a controller 100 and four pairs of low voltage push buttons 102, 104, 106 and 108. While four inverters are shown in this embodiment, other combinations of inverters are within the scope of this disclosure (e.g. less than four inverters or more than four inverters). Each inverter is coupled to a load 84, 90, 94 and 98. The AC power source 72 is filtered through an EMI filter 74 and rectified by the bridge rectifier 76. The bridge rectifier 76 supplies DC voltage to the power factor correction circuit 78. The power factor correction circuit 78, also referred to as a boost converter, provides a DC bus 98 and return line to the bus capacitor and each of the inverters.

Each inverter, 82, 86, 92 and 96, may be turned on or off by the controller 100 via control signal lines 110, 112, 114 and 116, respectively. In other words, each inverter is individually addressable and controllable by the controller. This is accomplished by discrete control signals to each inverter. This allows for the operation of zero to n inverters, where "n" is the number of inverters coupled to the DC bus and common return line (i.e. four inverters in the embodiment shown). For example, where the load on each of the four inverters is a gas discharge lamp, each capable of emitting approximately equivalent light, the ballast lamp circuit 70 is capable of dimming the lighting provided by the lamp fixture to about 75%, about 50% or about 25% by shutting down any of the inverters or the ballast lamp circuit can extinguish the fixture by shutting down all of the inverters.

Switching devices, ex. push button switches, 102, 104, 106 and 108 are operatively connected to the controller 100. The controller 100 houses four independent switching circuits as illustrated in FIG. 2, each switching circuit including two isolated switching circuits as illustrated. Switching device 102 is operatively connected to a first switching circuit, switching device 104 is operatively connected to a second switching circuit, switching device 106 is operatively connected to a third switching circuit and switching device 108 is operatively connected to a fourth switching circuit.

The first switching circuit outputs are operatively connected to control line 110, the second switching circuit outputs are operatively connected to control line 112, the third switching circuit outputs are operatively connected to control line 114 and the fourth switching circuit outputs are operatively connected to control line 116.

In operation, switching device 102 controls the on/off operation of lamp 84, switching device 104 controls the on/off operation of lamp 90, switching device 106 controls the on/off operation of lamp 94, and switching device 108 controls the on/off operation of lamp 98.

A feature of the exemplary embodiment includes packaging the components of the ballast circuit and controller, excluding the AC power source and loads, in a single enclosure. The enclosure is adaptable to mounting within a gas discharge lamp fixture. The enclosure may be hermetically sealed and/or potted. A number of additional packaging methods for the components of the ballast circuit are available and are known to those of skill in the art upon the reading of this application.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

| Reference Character | Component |
|---|---|
| 10 | gas discharge lamp dimming system |
| 12 | PFC circuit |
| 14 | ballast circuit |
| 16 | Lamp L1 |
| 18 | ballast circuit |
| 20 | Lamp L2 |
| 22 | controller |
| 30 | switch circuit |
| 32 | high frequency oscillator U1 |
| 34 | S-R latch, logic latch |
| 36 | switch S1 |
| 38 | capacitor C1 |
| 46 | capacitor C2 |
| 42 | Diode D1 |
| 44 | Diode D2 |
| 46 | Capacitor C3 |
| 48 | switch S2 |
| 50 | Capacitor C4 |
| 52 | Capacitor C5 |
| 54 | Diode D3 |
| 56 | Diode D4 |
| 58 | Capacitor C6 |
| 60 | graph |
| 62 | voltage curve |
| 70 | ballast lamp circuit |
| 72 | AC power source |
| 74 | emi filter |
| 76 | bridge rectifier |
| 78 | PFC circuit |
| 80 | bus capacitor |
| 82 | inverter |
| 84 | load/lamp |
| 86 | inverter |
| 88 | DC bus |
| 90 | load/lamp |
| 92 | inverter |
| 94 | load/lamp |
| 96 | inverter |
| 98 | load/lamp |
| 100 | controller |
| 102 | push button switch |
| 104 | push button switch |
| 106 | push button switch |
| 108 | push button switch |
| 110 | control signal line |
| 112 | control signal line |
| 114 | control signal line |
| 116 | control signal line |

What is claimed is:

1. A switch circuit comprising:

a high frequency oscillator including an output and a common ground;

a first latch including an input and an output;

a first, second and third capacitor, each capacitor including a first electrode and a second electrode; and a first diode and a second diode, each diode including an anode and a cathode, wherein the first capacitor's first electrode is operatively connected to the output of the high frequency oscillator, the second capacitor's first electrode is operatively connected to the anode of the first diode and the cathode of the second diode, the third capacitor's first electrode is operatively connected to the cathode of the first diode and the input to the latch, and the cathode of the second diode is operatively connected to the third capacitor's second electrode and the high frequency oscillator common ground.

2. The switch circuit of claim 1, wherein the serial capacitance of the first capacitor and second capacitor yield a capacitance in the range of 5 pF to 100 pF.

3. The switch circuit of claim 2, wherein the ratio of the capacitance of the third capacitor to the serial capacitance of the first capacitor and second capacitor, equals a value approximately equal to four orders of magnitude.

4. The switch circuit of claim 1, further comprising:

a second latch including an input and an output;

a fourth, fifth and sixth capacitor, each capacitor including a first electrode and a second electrode; and a third diode and fourth diode, each diode including an anode and a cathode, wherein the fourth capacitor's first electrode is operatively connected to the output of the high frequency oscillator, the fifth capacitor's first electrode is connected to the anode of the third diode and the cathode of the fourth diode, the sixth capacitor's first electrode is connected to the cathode of the third diode and the input to the second latch, and the cathode of the fourth diode is operatively connected to the sixth capacitor's second electrode and the high frequency oscillator common ground.

5. The switch circuit of claim 4, wherein the serial capacitance of the fourth capacitor and fifth capacitor yield a capacitance in the range of 5 pF to 100 pF.

6. The switch circuit of claim 5, wherein the ratio of the capacitance of the sixth capacitor to the serial capacitance of the fourth capacitor and fifth capacitor, equals a value approximately equal to four orders of magnitude.

7. The switch circuit of claim 4, wherein the serial capacitance of the first capacitor and second capacitor yield a capacitance in the range of 5 pF to 100 pF, the ratio of the capacitance of the third capacitor to the serial capacitance of the first capacitor and second capacitor equals a value approximately equal to four orders of magnitude, the serial capacitance of the fourth capacitor and fifth capacitor yield a capacitance in the range of 5 pF to 100 pF and the ratio of the capacitance of the sixth capacitor to the serial capacitance of the fourth capacitor and fifth capacitor, equals a value approximately equal to four orders of magnitude.

8. The switch circuit of claim 7, further including:

a first switch including a first and second pole, the first pole operatively connected to the first capacitor's second electrode and the second pole operatively connected to the second capacitor's first electrode; and a second switch including a first and second pole, the first pole operatively connected to the fourth capacitor's second electrode and the second pole operatively connected to the fifth capacitor's first electrode.

9. The switch circuit of claim 8, further comprising:

an inverter including a DC power input, an AC power output and a control input operatively connected to the first and second latch outputs, the inverter configured to provide AC power at the AC power output for a first predetermined control signal at the control input, the predetermined control signal initiated by the first switch, and the inverter configured to not provide AC power at the AC power output for a second predetermined control signal initiated by the second switch.

10. The switch circuit of claim 9, wherein the first switch and second switch include a S-R latch.

11. The switch circuit of claim 9, further comprising: a lamp operatively connected to the AC power output.

12. The switch circuit of claim 1, further comprising:

an inverter including a DC power input, an AC power output and a control input operatively connected to the first latch output, the inverter configured to provide AC power at the AC power output for a predetermined control signal at the control input.

13. The switch circuit of claim 1, further comprising:

a first switch including a first and second pole, the first pole operatively connected to the first capacitor's second electrode and the second pole operatively connected to the second capacitor's first electrode.

14. A ballast lamp circuit, comprising:

one or more inverters configured to receive power from a single DC power source, each inverter for selectively powering a load; and a controller operatively coupled to each of the one or more inverters via an on/off control signal for selectively switching on and off each inverter independently, the controller comprising one or more switch circuits, each switch circuit comprising:

a high frequency oscillator including an output and a common ground;

a first latch including an input and an output;

a first, second and third capacitor, each capacitor including a first electrode and a second electrode; and a first diode and a second diode, each diode including an anode and a cathode wherein the first capacitor's first electrode is operatively connected to the output of the high frequency oscillator, the second capacitor's first electrode is connected to the anode of the first diode and the cathode of the second diode, the third capacitor's first electrode is connected to the cathode of the first diode and the input to the latch, and the cathode of the second diode is operatively connected to the third capacitor's second electrode and the high frequency oscillator common ground.

15. The ballast lamp circuit according to claim 14, further comprising:

one or more switches, each switch including a first and second pole, the first pole operatively connected to the first capacitor's second electrode and the second pole operatively connected to the second capacitor's first electrode, wherein each of the one or more switches control one or more inverters via the on/off control signal.

16. The ballast of claim 14, one or more loads operatively connected to the one or more inverters wherein each load is one of the group consisting of a single gas discharge lamp, two serially-connected gas discharge lamps, and two parallel-connected gas discharge lamps.

17. A method of isolating a switch, comprising:

generating a high frequency low voltage AC waveform;

operatively connecting the high frequency low voltage AC waveform to a first pole of the switch via a first capacitor; and operatively connecting a second pole of the switch to a second capacitor, the second capacitor serially connected to a first diode and third capacitor, wherein the voltage across the third capacitor increases for each cycle of the high frequency low voltage AC waveform while the switch is closed, until a maximum voltage is obtained, and the first and second capacitor values are selected to provide substantial isolation of the switch from the voltage across the third capacitor and the high frequency low voltage AC waveform.

* * * * *